US006250793B1

(12) United States Patent
Gian

(10) Patent No.: US 6,250,793 B1
(45) Date of Patent: Jun. 26, 2001

(54) ANIMAL FEED ADDITIVE APPLICATION UTILIZING FOAM

(76) Inventor: Michael Gian, 1502 Kingsbury Rd., Garden City, KS (US) 67846

( * ) Notice: Subject to any disclaimer, the term of this patent is extended or adjusted under 35 U.S.C. 154(b) by 0 days.

(21) Appl. No.: 09/576,664

(22) Filed: May 23, 2000

(51) Int. Cl.[7] ..... B01F 15/02

(52) U.S. Cl. ..... 366/131; 360/150.1; 360/177.1

(58) Field of Search ..... 366/177.1, 179.1, 366/181.1, 181.2, 181.3, 181.8, 182.1, 182.3, 189, 190, 167.1, 114, 158.4, 191, 132, 150.1, 131, 134; 119/51.01

(56) References Cited

U.S. PATENT DOCUMENTS 2,737,129 * 3/1956 Johnson et al. ..... 366/181.1
2,746,728 * 5/1956 Pomerleau .
3,560,430 * 2/1971 Meyer et al. ..... 366/177.1

(List continued on next page.)

OTHER PUBLICATIONS

Kalo, Inc.; PCO Specimen Label and Product Profile for PCT FOAM™ Foam Concentrate, Oct. 1994.
Kalo, Inc.; Product Information for Benchmark™ Long Lasting Foam Marker and Foam Dye, no date.
Berghausen Corporation Products—Natural Foaming Agents, no date.
Sparhawk Laboratories, Material Safety Data Sheet for Vitamins A, D, & E, Feb. 3, 1993.
BASF Corporation, Material Safety Data Sheet for Vitamin E Acetate USP, FCC, Apr. 6, 1995.
A.L. Laboratories, Inc., Material Safety Data Sheet for Vitamin $D_3$, Jun. 10, 1993.
A.L. Laboratories, Inc., Material Safety Data Sheet for Vitamin A Propionate 2.5 w/BHT Veterinary Grade, no date.
Elanco Animal Health, Material Safety Data Sheet for Rumensin® 80, Oct. 1991.
Pfizer, Material Safety Data Sheet for Terramycin 50; Terramycin 50D; Terramycin 100; Terramycin 10; Terramycin 100D; Terramycin 100SS; and Terramycin 100 For Fish, Jan. 1991.
Elanco Animal Health, Material Safety Data Sheet for Tylan® 40 Premix, no date.
Syntex (U.S.A.) Inc., Material Safety Data Sheet for Cattlyst 50, Jan. 14, 1994.
BASF Wyandotte Corporation, Material Safety Data Sheet for Thiamine Mononitrate (Vitamin $B_1$), no date.
Rhone–Poulene, Inc., Material Safety Data Sheet, no date.
*1994 Feed Additive Compendium*, pp. 218–219 for Lasalocid, date 1994.
Rhodia, Inc., Material Safety Data Sheet for Freeze–Dried Bacterial Cultures.

*Primary Examiner*—Tony G. Soohoo
(74) *Attorney, Agent, or Firm*—Hovey, Williams, Timmons & Collins

(57) ABSTRACT

Methods and apparatuses are provided for applying accurately metered, minute quantities of concentrated additives from bulk sources of supply to successive masses of material presented for treatment. The methods of the invention comprise mixing an additive with a small amount of a liquid carrier to form a suspension, causing the suspension to foam, and applying the resulting foamed suspension to a material such as animal feed. The apparatuses of the invention provide for a pass-through chamber within which separate streams of a liquid carrier, an additive substance, and preferably a foaming agent are merged together. Each of the streams are directed into the chamber in a metered flow to incrementally combine the streams. A suction pump at the downstream end of the chamber draws the prepared product out of the chamber and advances it toward an ultimate delivery site. By utilizing foam, the methods and apparatuses of the invention require very little carrier liquid and result in a product which can be evenly and thoroughly distributed over the animal feed.

39 Claims, 1 Drawing Sheet

U.S. PATENT DOCUMENTS 3,782,695 * 1/1974 Sandiford ..... 366/181.8
3,870,283 * 3/1975 Hurst ..... 366/191
3,891,571 6/1975 Lambou et al. .
3,920,223 * 11/1975 Krueger ..... 366/177.1
3,995,838 * 12/1976 Zucker ..... 366/165.1
4,125,331 * 11/1978 Chisholm .
4,185,927 * 1/1980 Uttech ..... 366/131
4,367,953 * 1/1983 Hinz et al. ..... 366/132
4,430,001 * 2/1984 Schurr .
4,439,042 * 3/1984 Bertoglio .
4,499,561 * 2/1985 Mason et al. ..... 366/158.4
4,640,622 * 2/1987 Sortwell .
4,668,945 * 5/1987 Aldrovandi et al. .
4,712,921 * 12/1987 Sugiura ..... 366/336
4,778,280 * 10/1988 Brazelton ..... 366/181.8
4,801,210 1/1989 Gian ..... 366/150
4,859,072 * 8/1989 Fey et al. .
5,190,374 * 3/1993 Harms et al. .
5,256,419 10/1993 Roe et al. .
5,344,619 * 9/1994 Larwick et al. ..... 366/167.1
5,368,385 * 11/1994 Adamo et al. ..... 366/181.1
5,718,507 2/1998 Gian ..... 366/131

* cited by examiner

ANIMAL FEED ADDITIVE APPLICATION UTILIZING FOAM

BACKGROUND OF THE INVENTION

1. Field of the Invention

The present invention is broadly concerned with methods and apparatuses for applying a foamed product, comprising very small amounts of additive substances and requiring very small amounts of liquid carrier, to a large mass of materials such as animal feed. The product can be foamed by use of a foaming agent (either with or without subsequent agitation) or by agitating a suspension comprising the additive and liquid carrier without the addition of a foaming agent. Agitation can be carried out by any conventional mixing or vibrating mechanism or by injecting air under pressure into the suspension. Foaming of the suspension results in a product having increased surface area thus permitting an even, thorough distribution of the foamed additive onto the animal feed.

2. Description of the Prior Art

Animal feed additives, such as vitamins, innoculants, and nutritional supplements, are generally mixed with animal feed after the pellet is formed. Typically, a quantity of the additive material is measured by hand and added to a tank containing a specific, measured quantity of a liquid carrier such as oil or water. A stirrer is provided within the tank in an attempt to maintain the additive(s) in suspension, and the tank is then pressurized to direct the mixture through a spray nozzle and onto the feed pellets. This method has many drawbacks. An excess amount of the additive/liquid carrier suspension must be prepared in order to ensure the amount is sufficient to treat all of the feed. While this leads to wastage, the alternative is to make too little additive/liquid carrier suspension, thus requiring additional time and labor to prepare a new batch. Another drawback with this method is that the tank and mixing apparatus must be thoroughly cleaned after each use in order to prevent the growth of algae and other undesirable organisms.

Many of these problems were eliminated by the dosifying apparatus patented in U.S. Pat. No. 5,718,507 which provides a system for applying accurately metered, minute quantities of concentrated additives from bulk sources of supply to successive masses of material. While the system of the '507 is a vast improvement, it still requires the use of a large quantity of a liquid carrier (such as water) for the additives in order to ensure that all of the feed is covered with the additive. This results in wet feed which leads to mold growth on and spoilage of the feed. Furthermore, it is expensive and undesirable to use large quantities of the liquid carrier. This is especially true when water is the carrier, and the system is being used in an area where water is not plentiful. Finally, the spraying of the liquid carrier/additive suspension disclosed in the '507 patent results in splattering of the suspension, creating a wet, messy dispensing area and wasting valuable additives.

SUMMARY OF THE INVENTION

The instant invention overcomes the problems described above by providing a method and apparatus for foaming a suspension comprising an additive and a small quantity of a liquid carrier and dispersing the foamed suspension onto bulk quantities of animal feed. This additive-containing foam is distributed evenly and thoroughly over the surface of the animal feed without wasting the additives or resulting in wet feed which will easily spoil.

In more detail, the additives, either in dry or liquid form, are carefully dispensed in a metered flow into an ongoing stream of carrier liquid in a pass-through tubular mixing chamber. Preferably, the additive is dispensed by gravity into the stream of carrier liquid as it passes through the chamber such that each increment of the moving liquid is matched up with a corresponding increment of the additive material to form a suspension having a first volume. The resulting suspension is then foamed so that the resulting foamed suspension has a second volume which is at least about 1½ times greater than the first volume, preferably from about 15–30 times greater, and more preferably about 20 times greater. Foaming of the suspension can be carried out in several ways. For example, the suspension can be agitated, such as by introducing air (preferably at an air pressure of from about 5–50 psi) directly into the suspension, thus causing it to foam. If this does not create sufficient foaming, foaming of the suspension can also be achieved by the addition of a foaming agent to the suspension. If necessary, the suspension containing the foaming agent can then be agitated in some manner in order to increase the foaming of the product. This agitation can be carried out by some shaking means, or air can be introduced into the suspension containing the foaming agent (preferably at an air pressure of from about 5–50 psi) in order to increase the foaming. Suitable foaming agents in accordance with the invention include any edible foaming agent such as starch-based foaming agents, milk-based foaming agents, or fatty acid-based surfactants. Preferably, the chosen foaming agent (s) will not negatively interact with the additives to be dispersed on the feed. The apparatuses and methods of the invention can be used to apply virtually any substance, dry or liquid, that the user wishes to apply to a bulk material such as animal feed. For example, vitamins, innoculants, nutritional supplements, and pharmaceutical agents are all substances which can be applied in accordance with the invention. Finally, any liquid carrier known in the art is suitable for use in the instant invention, with water being a particularly preferred liquid carrier.

The resulting foamed product is then dispersed or otherwise applied to the mass of waiting animal feed. A suction at the chamber outlet draws the foamed product away from the chamber in a smooth flow. In its preferred form, the chamber is arranged in an upright condition with its outlet disposed at the bottom of the chamber, and the additive and foaming agent inlets located in a position to drop the additive and foaming agent directly into the outflowing stream of liquid. If necessary, the foamed product (which includes the carrier, additive, and foaming agent) may be passed through a region downstream from the mixing chamber wherein the ingredients are agitated. This may be necessary if it is not feasible to foam the product while it is still in the mixing chamber or if increased foaming of the product is desired. Furthermore, air may be injected into the system at that location in order to assist in propelling the product along the line downstream from the mixing chamber as well as to further increase the foaming of the product.

DETAILED DESCRIPTION OF THE PREFERRED EMBODIMENTS

Figure 1:
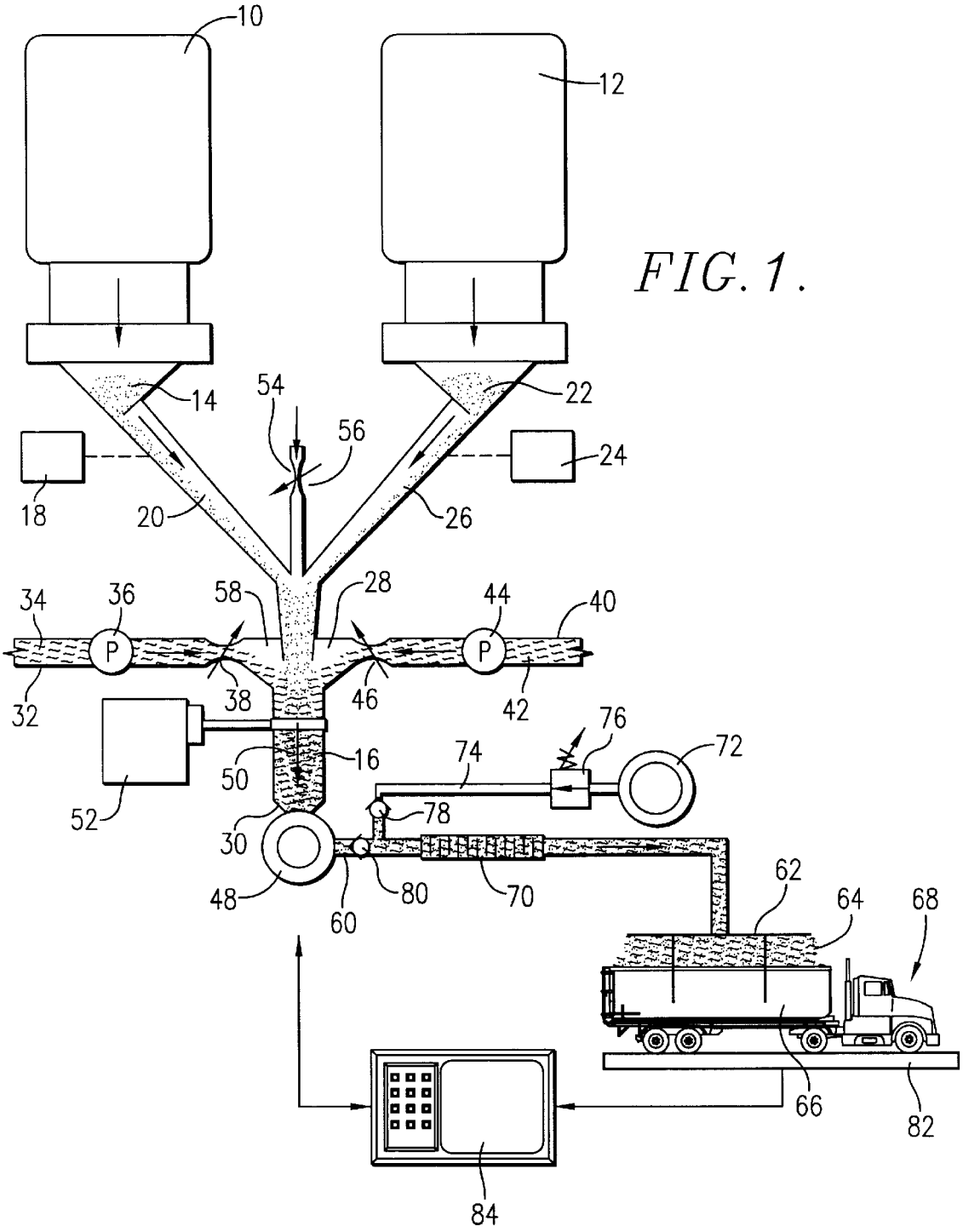
FIG. 1 is a schematic drawing of a dosifying or materials application system in accordance with the present invention.

The system of the present invention includes a hopper or other container 10 serving as a source of supply for concentrated additive and a hopper or other container 12 serving as a source of supply for a foaming agent. In the illustrated embodiment, the hopper 10 is designed to store a supply of dry additive, but the hopper could be designed for holding liquid additive as well. Suitable metering mechanism in the nature of an auger or other means feeds the dry additive 14 from the hopper 10 toward a tubular, pass-through mixing or combining chamber 16 where the additive 14 is combined with a suitable liquid carrier, such as oil or water. In the illustrated embodiment, a vibrator 18 coupled with a downwardly sloping delivery conduit 20 serves to accurately meter the dry additive 14 into the chamber 16.

Hopper 12 is designed to store a supply of a foaming agent. A suitable metering mechanism feeds the foaming agent 22 from hopper 12 toward chamber 16 where the foaming agent 22 is combined with the additive 14 and the liquid carrier. A vibrator 24 coupled with a downwardly sloping delivery conduit 26 serves to accurately meter the foaming agent 22 into chamber 16.

The chamber 16 is preferably arranged in an upright disposition so that an inlet 28 is presented at its upper end and an outlet 30 is presented at its lower end. The delivery conduits 20, 26 from the additive supply hopper 10 and foaming agent supply hopper 12, respectively, project down into the outwardly flaring inlet 28 so that the additive 14 and the foaming agent 22 are dropped in a metered flow directly into the inlet 28, preferably in the center thereof.

At least one type of liquid carrier is supplied to the mixing chamber 16 for combining with additive 14 and foaming agent 22. In the illustrated embodiment, one delivery conduit 32 leads from a source of bulk supply of liquid carrier 34, such as water, and empties directly into the inlet 28. A pump 36 moves the carrier through the conduit 32, and a variable outlet orifice 38 in conduit 32 permits the rate and volume of flow to be controlled. If desired, a second delivery conduit 40 for a liquid carrier may be provided, depending upon the ultimate mixture to be obtained, such conduit 40 containing a second liquid carrier 42, having a second pump 44, and being provided with a second variable outlet orifice 46.

A discharge pump 48 is coupled with the chamber outlet 30 so as to draw a suction on the chamber 16. Thus, additive, foaming agent, and liquid carrier introduced onto the inlet 28 by their respective sources of supply are combined within the chamber 16 into a mixed product which is then pumped to downstream portions of the system by the discharge pump 48. The capacities and flow volume rates of the pumps 36, 44, and 48, as well as the relative cross-sectional sizes of the outlets 30, 38, and 46 should be so regulated that the product formed within the chamber 16 does not collect in a pool within the chamber but instead is constantly flowing through the chamber at a steady rate. The liquid carrier is presented to the inlet 28 in the form of a steady stream for mixing with the metered flow of the additive and the foaming agent. In this way, the additive and foaming agent combines with the liquid carrier increment by increment, instead of all at one time as in a vat type mixing system. Furthermore, the incoming liquid continuously washes the walls of the chamber to keep the additive from sticking to those surfaces.

It is highly desirable to obtain smooth, laminar flow of the product through the chamber 16. Therefore, it may be desirable in some instances to not only draw a suction on the outlet 30 of the chamber 16 with the pump 48, but also to form a suction vortex illustrated by the number 50 within the mixed product above the outlet 30. When the vortex 50 is present, the product swirls around the interior of the chamber 16 in a laminar flow manner, and thus moves quickly through the system without causing dead spots in the flow where the additive can settle out. The swirling vortex also assists in foaming the product and keeps the additive from sticking to the walls of the chamber. The vertical orientation of the chamber 16 is beneficial in creating the suction vortex inasmuch as the force of gravity helps draw the liquid out of the chamber 16 through the outlet 30. Preferably, the cross-sectional area of the outlet 30 exceeds the effective combined cross-sectional areas of the outlet orifices 38 and 46 at all times so that the product within chamber 16 cannot collect to such a level that it will engage the bottom ends of the additive delivery conduit 20 and foaming agent delivery conduit 26. Additionally, it is preferred that the upper end of the chamber 16 at the inlet 28 be generally funnel shaped with sloping interior surfaces. The streams thus entering the chamber 16 engage and flow along the sloping surfaces of the inlet 28 toward the outlet 30 with a tendency to swirl as they flow. A vibrator 52 below the inlet 28 is mechanically coupled with the chamber 16 and may be utilized to oscillate the chamber 16 in a circular motion so as to augment the swirling action obtained within the chamber 16 and the conical inlet 28 as well as to assist in foaming the product.

Intersecting the additive supply conduit 20 and foaming agent supply conduit 26 at a point above the chamber 16 is a gas delivery passage 54 having a variable outlet orifice 56. The passage 54 may be used to supply the chamber 16 and downstream portions of the system with an additive gas under pressure. On the other hand, the passage 54 could also be used to simply draw in ambient air in regulated amounts so as to adjust the suction available from the pump 48. Or, passage 54 could be used to provide air in order to increase the foaming of the additive 14 in the liquid carrier 34. In any case, the upper end of the chamber 16 is preferably provided with a closure 58 that seals the chamber 16 from the atmosphere, except that air which may be supplied via the passage 54 when the same is used to admit ambient air. In some situations, such as when no gas is desired to be introduced to the chamber 16, the closure 58 may be eliminated such that the funnel area is completely open to the atmosphere, except that air which may be supplied via the passage 54 when the same is used to admit ambient air.

The pump 48 discharges the product with positive pressure into a discharge conduit 60 leading to a dispensing head 62. In one use of the invention, the dispensing head 62 may be positioned in such a manner so as to release the product in the form of a foam 64 that is directed onto the contents of an open top container 66 forming part of a truck 68. The container 66 with its mass of animal feed and dose of foamed micro-ingredients from the additive supply hopper 10 can be thereafter delivered to the feeding site or other locations for ultimate distribution.

In some situations, it may be desirable to provide an augmentation chamber 70 within the discharge conduit 60 which subjects the product to agitation and additional mixing after the ingredients have been combined within the chamber 16 and moved through the discharge pump 48. The augmentation chamber 70 may take a variety of different forms including, for example, a set of staggered deflecting baffles or the like within the path of flow of the product to force the product to move in a serpentine path and create turbulence. Thus, augmentation chamber 70 further serves to increase the foaming of the additive/liquid carrier/foaming agent mixture, providing better coverage of the mixture over the animal feed.

It may also be necessary to add positive pressure air to the discharge conduit 60 downstream from the pump 48 to assist in transferring the product through the augmentation chamber 70 and the rest of the downstream portions of the discharge conduit 60. Such positive pressure air may be supplied by an air pump 72 connected to the discharge conduit 60 via a supply line 74. A control valve 76 in the line 74 regulates the volume of air added to the discharge conduit 60, and a check valve 78 downstream from the control valve 76 but upstream from the discharge conduit 60 prevents product from entering the air supply line 74 to any significant extent. Another check valve 80 in the discharge line 60 downstream from the pump 48 prevents air from the supply pump 72 from entering the discharge pump 48. The air from pump 72 can also be utilized to dry out the discharge line 60 and the augmentation chamber 70 after each batch of product has been prepared and distributed. Preferably, the entire system is flushed prior to such drying action by simply allowing the appropriate liquid carrier 34 or 42 to pass through the chamber 16, pump 48 and discharge conduit 60 without the introduction of any additive or foaming agent from the supply hoppers 10, 12, respectively.

When the truck 68 arrives at the dispensing station as illustrated in the drawing, the contents of the container 66 may be weighed using a scale 82 that inputs the resulting information to a computer 84 such that, when the weight of the contents is known, the computer 84 can then appropriately signal the rest of the system to release only the appropriate amount of additive from hopper 10 and foaming agent from hopper 12 for the particular job. Thus, for each truck that arrives, the system has the ability to adjust itself to supply a batch of additive in accordance with a pre-established concentration schedule and accordingly adjust itself to supply the amount of foaming agent necessary to achieve appropriate foaming levels. In other words, if a certain amount of additive is desired per each unit of mass to be treated, that concentration can be maintained despite significant variations in the weights of successive masses of materials delivered to the dispensing station. It is only necessary to so program the computer 84 that it will allow only the proper amount of additive to be released from hopper 10 that is appropriate for the particular mass of material at the dispensing station, as well as the proper amount of foaming agent which appropriate for the type and amount of additive to be dispensed.

It is also to be understood that the present invention contemplates the use of several different additive hoppers 10, each containing their own particular additive. Furthermore, several different foaming agent hoppers 12 could be utilized so that the foaming agent, or combination of foaming agents, could be selected based upon the particular additive(s) which would be used. Thus, the weight of the mass of material within the truck container 66 can be utilized to determine how much additive from several different hoppers is to be dispensed to the material within the truck container. Each additive hopper would preferably be associated with its own mixing chamber, foaming agent supply hopper, and liquid carrier supply stream, as well as its own discharge line to the point of dispensing the product onto the material within the truck container. At that location, the various lines could be merged together into a common dispensing head, or the truck could be advanced seriatim along a line of several different dispensing heads according to the number of hoppers utilized.

It is also important to appreciate that the present invention has particular utility in connection with the preparation and dispensing of relatively small amounts of additive compared to the relatively large masses of materials contained within the successive truck containers 66. Furthermore, the use of a foaming agent allows for substantially less liquid carrier (which is generally water) to be used than has been necessary in the past. Those skilled in the art will appreciate that using such a small amount of liquid carrier decreases the problems associated with wet feed (such as mold growth and feed spoilage) while still achieving even, thorough distribution of the additives over the feed. Furthermore, using smaller quantities of a liquid carrier such as water is better for the environment. Finally, dispersing a foam on the feed rather than spraying a liquid on the feed avoids the mess created by the splattering liquid Prior to the instant invention, thoroughly and uniformly dispersing 320 mg of Micro-cell® (a microbial feed additive for beef cattle available from Biotal, Inc., Eden Prairie, Minn.) over 16,000 lbs of feed required mixing the Micro-cell® with 20 gallons of water. By foaming the product in accordance with the invention, the same quantity of Micro-cell® can be uniformly dispersed over 16,000 lbs of feed with only 1.25 gallons of water, a 93% decrease in the volume of water required.

The methods of the invention can be utilized with any known feed additives. Those additives include vitamins such as vitamins A, D, and E, and nutritional additives such as RUMENSIN® 80 (Elanco Animal Health, Indianapolis, Ind.), any TERRAMYCIN® product (Pfizer Animal Health Division, Lee's Summit, Mo.), TYLAN 40 (Elanco Products Co., Indianapolis, Ind.), MGA 500® (The Upjohn co., Kalamazoo, Mich.), and Biotal Micro-cell®. Furthermore, the methods of the invention are not limited to applications on feed for beef cattle, but can also be used on feed for sheep, swine, fowl, or virtually any other animal for which additives must be dispersed efficiently on bulk quantities of feed. The feed can be in the form of pellets, finely ground meal, grains, corn, or any other form which may be desired.

Suitable foaming agents for use with the instant invention include any edible foaming agent such as starch-based foaming agents, milk-based foaming agents, or fatty acid-based surfactants. Preferably, the chosen foaming agent(s) will not interact with the additives to be dispersed on the feed. Or, as an alternative to adding a foaming agent, the additive/liquid carrier mixture can be foamed with air at a pressure of from about 5–50 psi. In the embodiment illustrated, the air could be delivered via passage 54 causing the additive/liquid carrier mixture to foam within mixing chamber 16, or the air could be delivered by pump 72 through line 74 for foaming within conduit 60 and augmentation chamber 70. Finally, the liquid carrier could be carbonated in order to create a foam.

I claim:

1. A dosifying system for making a batch of foamed products including a liquid carrier and an additive, said system comprising:

a chamber having an inlet and an outlet;

a liquid supply line for delivering the liquid carrier to the inlet of the chamber in a stream;

an incremental delivery device for delivering a measured quantity of the additive to the inlet of said chamber in a metered flow for combining said additive and said liquid carrier within said chamber to form a suspension;

apparatus operable to foam said suspension to form the foamed product;

a pump coupled with the outlet of said chamber for drawing the product out of the chamber as the suspension is foamed within the chamber; and a delivery conduit coupled with said pump in downstream relation to the chamber for receiving the product from the pump and directing the product to a point of delivery.

2. The system of claim 1, wherein said foaming apparatus comprises an incremental delivery device for delivering a measured quantity of a foaming agent to the inlet of the chamber in a metered flow for combining said foaming agent with said additive and said liquid carrier within said chamber.

3. The system of claim 2, further including an agitator coupled with said chamber to agitate the chamber.

4. The system of claim 2, further including an agitator comprising an air delivery conduit operable to introduce air under an air pressure of from about 5–50 psi into said chamber.

5. The system of claim 2, wherein said foaming agent is starch-based.

6. The system of claim 1, wherein said foaming apparatus comprises an air delivery conduit for introducing air under an air pressure of from about 5–50 psi into said chamber.

7. The system of claim 1, said chamber being disposed with said outlet below said inlet.

8. The system of claim 7, said chamber having a conical portion, with sides that converge as said outlet is approached.

9. The system of claim 1, said mechanism including structure to deliver dry additive material to said chamber.

10. The system of claim 1, said additive being selected from the group consisting of vitamins and pharmaceutical agents.

11. The system of claim 1, said delivery conduit containing a plurality of baffles disposed to cause the product to experience turbulence as it encounters the baffles.

12. The system of claim 1, further including a blower coupled with said delivery conduit for introducing air under positive pressure to said conduit.

13. A dosifying system for supplying successive batches of foamed products including a liquid carrier and predetermined amounts of an additive to a point of delivery comprising:

a chamber having an inlet and an outlet;

a bulk source of supply of said liquid carrier;

a liquid supply line operable to deliver a volume of the liquid carrier from the source of supply to the inlet of the chamber for each batch of product;

a bulk source of supply of said additive;

an incremental delivery device for delivering a measured quantity of the additive from the bulk source of supply of the additive to the inlet of the chamber for each batch of product, said device being operable to deliver each quantity of the additive to the chamber in a metered flow for combining said additive and said liquid carrier within said chamber to form a suspension;

apparatus operable to foam each batch of said suspension to form the foamed product;

a pump coupled with the outlet of said chamber for drawing the product out of the chamber as the suspension is foamed within the chamber; and a delivery conduit coupled with said pump in downstream relation to the chamber for receiving the product from the pump and directing the product to a point of delivery until the entire batch has been delivered.

14. The system of claim 13, wherein said foaming apparatus comprises an incremental delivery device for delivering a measured quantity of a foaming agent to the inlet of the chamber in a metered flow for combining said foaming agent with said additive and said liquid carrier within said chamber.

15. The system of claim 14, further including an agitator coupled with said chamber to agitate the chamber.

16. The system of claim 14, further including an agitator comprising an air delivery conduit for introducing air under an air pressure of from about 5–50 psi into said chamber.

17. The system of claim 14, wherein said foaming agent is starch-based.

18. The system of claim 13, wherein said foaming apparatus comprises an air delivery conduit for introducing air under an air pressure of from about 5–50 psi into said chamber.

19. The system of claim 13, said chamber being disposed with said outlet below said inlet.

20. The system of claim 19, said chamber having a conical portion, with sides that converge as said outlet is approached.

21. The system of claim 13, said mechanism including structure to deliver dry additive material to said chamber.

22. The system of claim 13, said additive being selected from the group consisting of vitamins and pharmaceutical agents.

23. The system of claim 13, said delivery conduit containing a plurality of baffles disposed to cause the product to experience turbulence as it encounters the baffles.

24. The system of claim 13, further including a blower coupled with said delivery conduit for introducing air under positive pressure to said conduit.

25. A method of applying additives to animal feed comprising:

creating a suspension comprising an additive and a liquid carrier, said suspension having a first volume;

causing said suspension to foam, said foamed suspension having a second volume which is at least about 1½ times greater than said first volume; and applying said foamed suspension to said animal feed.

26. The method of claim 25, wherein said additive is selected from the group consisting of pharmaceutical agents, vitamins, and nutritional supplements.

27. The method of claim 25, wherein said suspension further includes a foaming agent.

28. The method of claim 27, wherein said causing step comprises agitating said suspension.

29. The method of claim 28, wherein said agitating is carried out by the introduction of air into said suspension.

30. The method of claim 29, wherein said air is introduced at an air pressure of from about 5–50 psi.

31. The method of claim 27, wherein said foaming agent is starch-based.

32. The method of claim 25, wherein said causing step comprises introducing air into said suspension.

33. The method of claim 32, wherein said air is introduced at an air pressure of from about 5–50 psi.

34. The method of claim 25, wherein said liquid carrier is water.

35. The method of claim 25, wherein said second volume is at least about 15 to 30 times greater than said first volume.

36. The method of claim 25, wherein said second volume is about 20 times greater than said first volume.

37. In a process for dosifying a bulk material by delivering a measured quantity of a liquid carrier and a measured quantity of an additive to the inlet of a chamber to form a suspension, delivering said suspension to a point of delivery, and applying said suspension to said bulk material, the improvement comprising making a foam from at least a portion of said suspension prior to said application.

38. The process of claim 37, wherein said bulk material is an animal feed.

39. The process of claim 37, wherein said foam-making step comprises adding a foaming agent to said suspension.

* * * * *